United States Patent [19]

Kawano et al.

[11] Patent Number: 4,740,767

[45] Date of Patent: Apr. 26, 1988

[54] PIVOTING DEVELOPING DEVICES

[75] Inventors: Yuzo Kawano; Yosuke Ohata, both of Osaka, Japan

[73] Assignee: Mita Industrial Co., Ltd., Osaka, Japan

[21] Appl. No.: 934,597

[22] Filed: Nov. 21, 1986

[30] Foreign Application Priority Data

Nov. 30, 1985 [JP] Japan ..... 60-270079

[51] Int. Cl.[4] ..... G03G 15/00

[52] U.S. Cl. ..... 355/3 DD; 355/3 DR; 355/14 D

[58] Field of Search ..... 355/3 DD, 3 DR, 4, 14 D, 355/3 R, 14 SH

[56] References Cited

U.S. PATENT DOCUMENTS

| | | | |
|---|---|---|---|
| 3,819,263 | 6/1974 | Draugelis et al. | 355/4 |
| 3,970,042 | 7/1976 | Rees | 355/4 |
| 4,336,994 | 6/1982 | Banton | 355/8 |
| 4,339,196 | 6/1982 | Beck et al. | 355/14 D |
| 4,563,074 | 1/1986 | Tsutsui et al. | 355/3 DD |
| 4,583,832 | 4/1986 | Kasamura et al. | 355/14 D |
| 4,593,993 | 6/1986 | Imaizumi | 355/3 SH X |

FOREIGN PATENT DOCUMENTS

| | | | |
|---|---|---|---|
| 181058 | 10/1983 | Japan | 355/3 DR |
| 52876 | 3/1985 | Japan | 355/3 DD |

*Primary Examiner*—A. T. Grimley
*Assistant Examiner*—Ed Pipala
*Attorney, Agent, or Firm*—Jordan and Hamburg

[57] ABSTRACT

A developing device includes a unit support member attached to an opening formed in a front panel of image forming apparatus, support for supporting the unit between the unit support member and a rear panel of the apparatus with the unit pivotable about an axis parallel to the rotation axis of the photoreceptor, and a guide mechanism for guiding a casing of the unit, whereby when the unit is set in the apparatus, a developing sleeve is put in a first state in which the sleeve is near the photoreceptor, and when the unit is inserted in and drawn out of the apparatus, the sleeve is put in a second state in which the sleeve is spaced apart from the photoreceptor. Also when the unit is set in the apparatus, the sleeve is changed from the first state to the second state and vice versa. Accordingly, the unit is replaced through the front panel of the apparatus with ease, and there is eliminated the necessity to provide an excessive space for inserting and drawing the unit in the apparatus, while preventing the developer from unnecessarily coming into contact with the photoreceptor in the non-developing stages, whereby monocolor developing is assuredly performed.

13 Claims, 14 Drawing Sheets

PIVOTING DEVELOPING DEVICES

BACKGROUND OF THE INVENTION AND RELATED ART STATEMENT

This invention relates to a developing device for use in image forming apparatus, such as electrostatic copying machines and facsimile apparatus, particularly a developing device including a developing unit disposed around a photoreceptor which is able to insert and draw along the rotation axis of the photoreceptor and a developing sleeve of which is able to move to from the photoreceptor.

In such type of developing device, there has been a developing device in the form of a cartridge which is removably set in the copying machine so as to enable developing units holding different color developers to replace with one another and make maintenance of developing units accessible, for example, a developing device of Japanese Unexamined Patent Publication No. 22907/60. The conventional device disclosed in the above publication is so constructed as to insert the unit into and draw out of apparatus in a vertical direction. The unit is inserted and drawn through an insertion hole provided at the same height as an original plate of the apparatus. The height is suitable for copying operation but considerably high for inserting and drawing the unit. Also, since the developing unit is a fairly heavy, handling of the developing unit is not easy. In the case of a copying machine equipped with a movable optical system for illuminating an original in an upper portion thereof, an additional space is necessary in order to provide a passage for inserting and drawing the unit in the vertical direction.

When providing a plurality of developing units holding different color developers respectively around a photoreceptor, they are generally arranged in a vertical direction. In the case of the above-mentioned developing device in which the unit is vertically inserted and drawn, as far as an upper-arranged developing unit is drawn out of the apparatus, a lower-arranged developing device can not be drawn. Accordingly, the conventional device needs a troublesome operation.

There has been another developing device which is constructed in such a manner that when setting the a developing unit in the apparatus, the unit is held near the photoreceptor so as to make developing executable, when inserting and drawing the unit, the unit is held apart from the photoreceptor so as to prevent the developing unit from striking the photoreceptor and then marring it, for example, a device of Japanese Unexamined Utility Model Publication No. 52746/56. In the device of the Utility Model Publication, the whole developing unit is moved in a horizontal direction to obtain a given distance between the photoreceptor and the unit. Accordingly, since apparatus equipped with the device needs an increased space, it is difficult to produce a compact apparatus.

Furthermore, heretofore has been known a developing device including a plurality of replaceable developing units provided around a photoreceptor to make multicolor copying effectable, the unit having a rotatable developing sleeve of non-magnetic material, and a magnet so rotatably provided in the sleeve as to render the rotation angle of the sleeve change according to whether or not the unit is put into operation. More specifically, in a unit put into developing operation, the magnet in the developing sleeve is rotated so that the main pole of the magnet faces the photoreceptor and then a magnetic brush of developer is formed on the portion of the sleeve surface which faces the photoreceptor. On the other hand, in a unit suspended from developing, the magnet in the developing sleeve is rotated so that the main pole of the magnet does not face the photoreceptor and then a magnetic brush of developer is kept away from the photoreceptor to prevent the developer of the suspended unit from straying into the developer being put into developing. Consequently, the device enables monocolor developing and superposition developing and further multicolor momocolor developing and multicolor superposition developing by replaceing developing units holding developers of different colors with one another.

However, this conventional device is very complicated in construction because the magnets in the sleeves is necessary to be rotated oppositely by the use of a solenoid or the like. It will be seen that if the device is constructed in such a manner that a trough of a magnetic brush of developer faces the photoreceptor with a little rotation of the magnet, the construction of the magnet rotating means becomes simpler. In this case, however, there is a likelihood that since the distance betweeen the seleeve and the photoreceptor is small, toner of the developer held in the unit suspended form developing is electrostatically attracted to an latent image formed on the photoreceptor and consequently toner of a part of developer different from the developer being used is developed. Also, there is a likelihood that since the magnet is rotated by electrical means, if the electrical means fails to operate properly, the magnetic brushes formed on all the developing sleeves face the photoreceptor, or the troughs of the brushes formed on all the sleeves face the photoreceptor, consequently the toners of different developers coming into contact with the photoreceptor at the same time, or no toners coming into contact with the photoreceptor.

Furthermore, the device has been greately demanded which is simple in construction and can be changed from a first state that a developing sleeve is put near a photoreceptor to make developing executable to a second state that the sleeve is moved away from the photoreceptor to make developing impossible and vice versa when the unit is set in apparatus in order to prevent the following incidents: incident that in operation stages outside the developing stage, such as warming-up stage and cleaning stage, the photoreceptor rotates with the photoreceptorin contact with a magnetic brush and the surface of photoreceptor consequently is scratched; incident that the developer comes into an aggregate with the developers being in contact with the photoreceptor due to a fact that the apparatus is suspended for a long period of time and then impairs the photoreceptor surface.

It is an object of the present invention to overcome the aforementioned problems.

Other objects and advantages of the present invention will become apparent from the following description of the present invention.

SUMMARY OF THE INVENTION

A device of the present invention comprises an opening formed in a front panel of an image forming apparatus for inserting and drawing an developing unit, a unit support member removably attached to the opening, means for supporting the unit between the unit support member and a rear panel of the apparatus with the unit pivotable about a line parallel to the rotation axis of the photoreceptor, and a guide mechanism for guiding a casing of the unit, whereby when the unit is set in the apparatus, a developing sleeve is put in a first state that the sleeve is near the photoreceptor, when the unit is inserted in and drawn out of the apparatus, the sleeve is put in a second state that the sleeve is apart from the photoreceptor. Accordingly, the developing unit is inserted and drawn in a horizontal direction through the front panel. Comparing to the device in which the developing unit is inserted and drawn in a vertical direction, the inserting and drawing of unit can be performed with ease. Also, in the case of arranging a plurality of developing units in a vertical direction, a selected unit can be replaced without drawing other units. Accordingly, the replacement of developing units and maintenance are easily performed, which makes it easy to monodevelop a multicolored image. Moreover, the kind of apparatus for which the device is applied is not limited on account of the fact that when used in a copying machine equipped with a movable optical system in the upper portion thereof, it is not necessary to provide a space for inserting and drawing the unit.

Furthermore, the developing sleeve is moved to and from the photoreceptor by pivoting the unit. Accordingly, comparing to the device in which the sleeve is moved in a horizontal direction, the present invention needs a smaller moving distance to obtain the same space as the conventional device, which is therefore advantageous for producing a compact apparatus of a reduced space. When drawing the developing unit which is set in the apparatus and also put in the first state that the sleeve is placed near the photoreceptor to make developing executable, the guide mechanism automatically changes the unit into the second state of suspending the sleeve from developing. Accordingly, a magnetic brush formed on the sleeve is prevented from scratching the photoreceptor.

Another device of the present invention comprises an opening formed in a front panel of apparatus, a unit support member removably attached to the opening, means for supporting a developing unit between the unit support member and a rear panel of the apparatus with the unit rotatable about a line parallel to the rotation axis of a photoreceptor, and a guide mechanism for guiding a casing of the unit, whereby when the unit is set in the apparatus a developing sleeve is changed from a first state that the sleeve is near the photoreceptor to a second state that the sleeve is apart from the photoreceptor and vice versa, and a changing mechanism for changing the unit from the first state to the second state and vice versa.

This device makes it possible that while the unit is set in the apparatus, the sleeve is kept apart from the photoreceptor by pivoting the unit. Accordingly, it is easily prevented that in operation stages outside the developing stage, the developer unnecessarily comes into contact with the photoreceptor and then mars and impairs the surface of photoreceptor.

The device, which is provided with a plurality of developing units around the photoreceptor and the changing mechanism for oppositely changing units so that when one unit is put in the first state that the sleeve is near the photoreceptor, other units are put in the second state that the sleeve is apart from the photoreceptor, eliminates double-color developing that different color developers are used for developing at the same time.

DETAILED DESCRIPTION OF PREFERRED EMBODIMENTS OF THE INVENTION

An embodiment of the present invention is described with reference to FIGS. 1 to 9.

Figure 1:
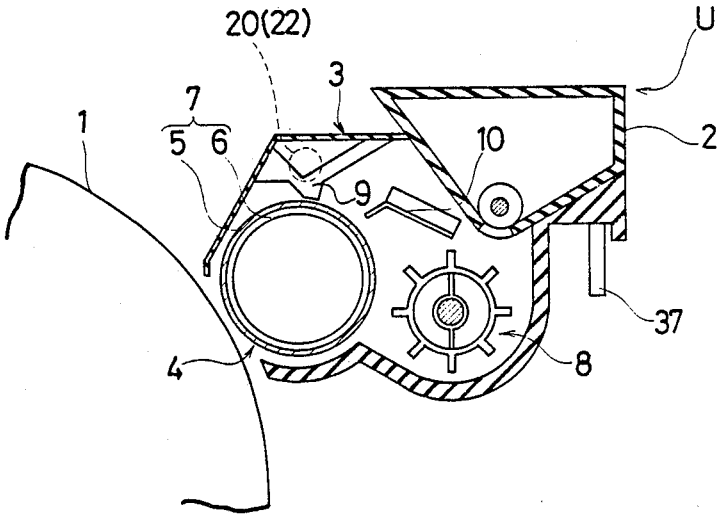
FIG. 1 is a skeleton section of a first embodiment of the present invention.

FIG. 1 shows a developing device including a developing unit U disposed near the periphery of a photoreceptor 1. The developing unit U comprises a casing 3 having a toner supply hopper 2 and formed with an opening 4 facing the photoreceptor 1, a developing roller 7 disposed in the casing 3 and along the opening 4 and consisting of a non-magnetic rotary developing sleeve 5 and a magnetic stationary roller 6 disposed in the sleeve 5, and agitater 8 for agitating developer and feeding the developer to the sleeve 5, means 9 for trimming magnetic brush formed on the outside of the sleeve 5, and a plate 10 for returning the developer from the trimming means 9 to the agitator 8. The developing unit U is pivotable about a line parallel with the rotation axis of the photoreceptor 1 and changable from a first state that the sleeve 5 is positioned near the photoreceptor 1 so as to enable developing to a second state that the sleeve 5 is kept apart from the photoreceptor 1 so as to suspend developing and vice versa. FIG. 1 shows the first state.

Figure 2:
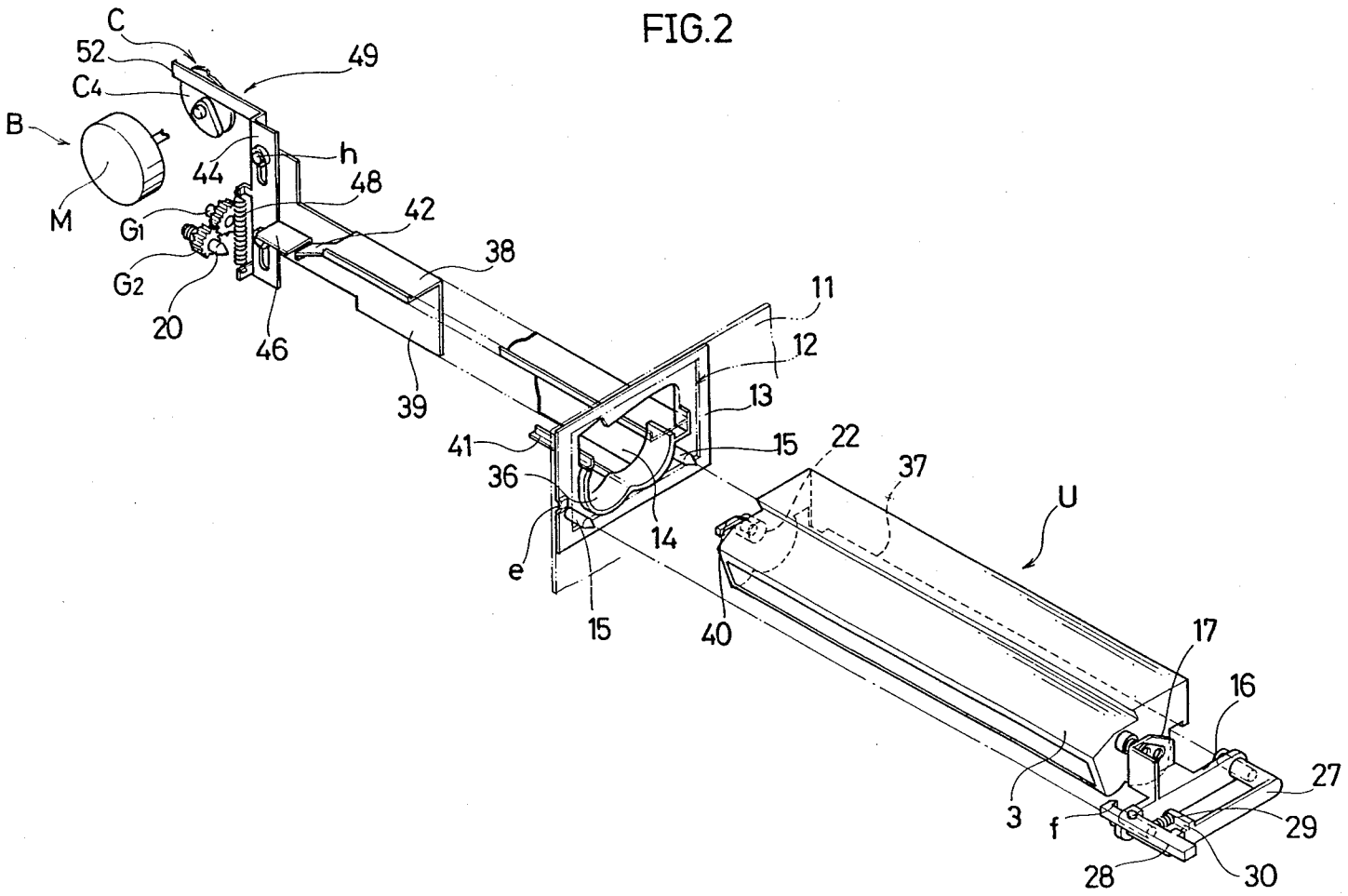
FIG. 2 is an explanatory perspective view illustrating inserting and drawing of a developing unit of the first embodiment.
Figure 3:
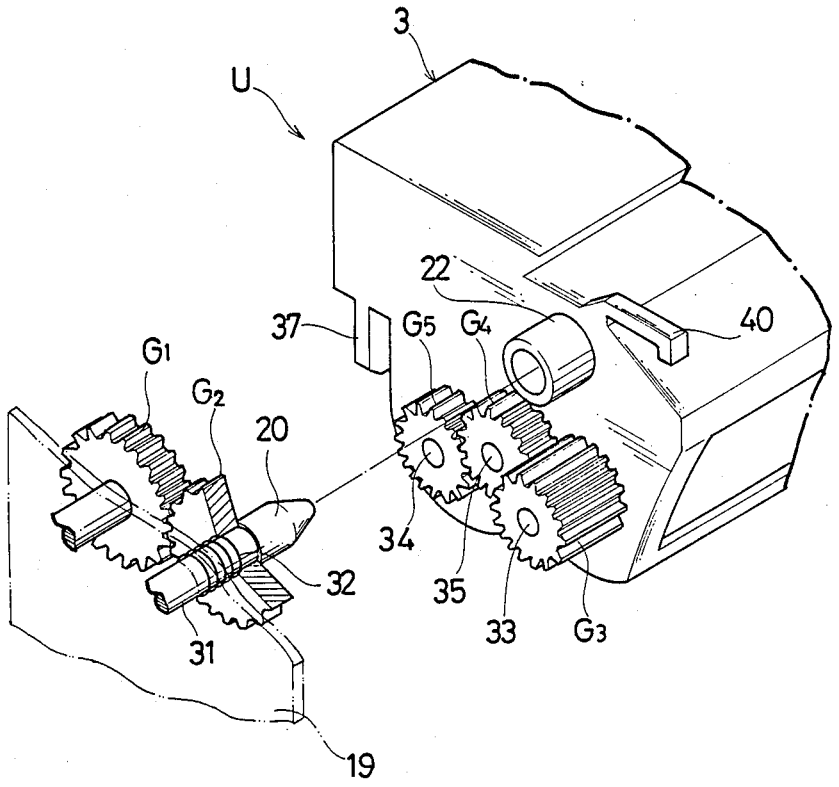
FIG. 3 is a perspective view showing a gear mechanism of the first embodiment.
Figure 4:
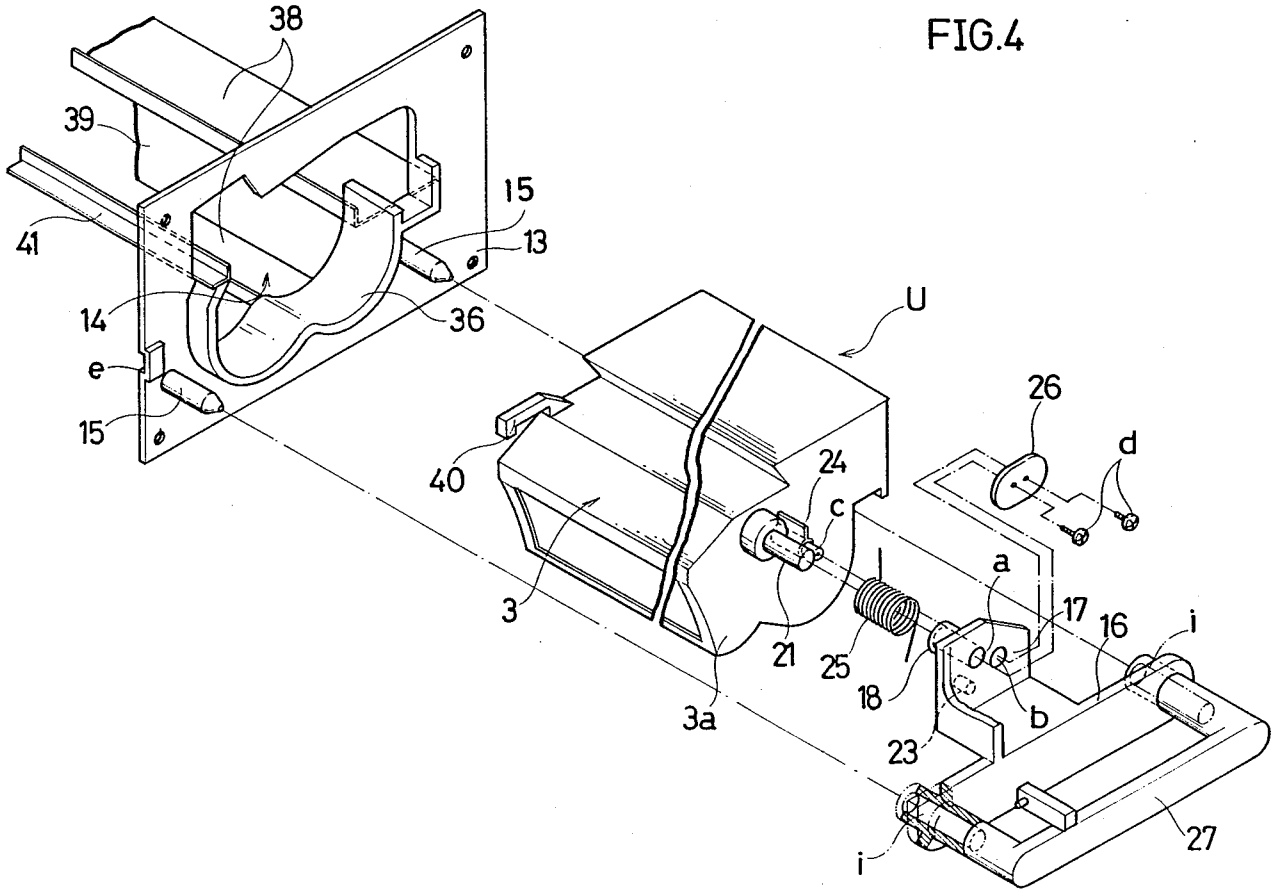
FIG. 4 is an exploded perspective view showing an essential portion of the first embodiment.
Figure 5:
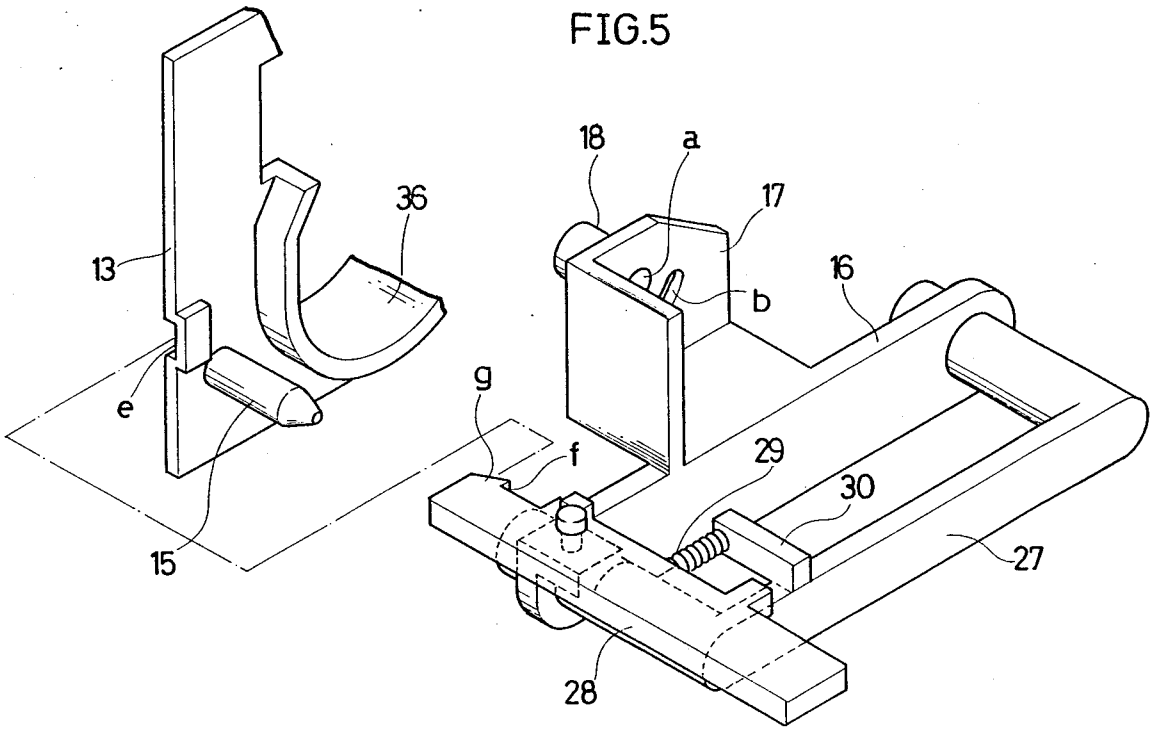
FIG. 5 is a perspective view showing means for fixing the unit.

More specifically, referring to FIGS. 2 to 4, in the front panel 11 of a copying machine is formed an opening 12 for drawing and inserting the developing unit U along the axis of the sleeve 5. A member 13 for receiving the unit U is attached to the panel. The receiving member 13 has a hole 14 for inserting the unit U having a configuration corresponding to a cross outline of the unit U and two support pins 15, 15 at right and left sides of the hole 14. The pin 15 is projected horizontally outward.

The unit U has a unit support member 16 to be removably attached to the support pins 15, 15. The unit support member 16 has a bracket 17 equipped with a support hollow cylinder 18 or supporting member. On the rear planel 19 of the machine is provided a support pin 20 or supporting member. The support cylinder 18 and support pin 20 are aligned in a line parallel with the axis of the photorecepter 1. On the other hand, the casing 3 of the unit U has a pin 21 or supported member to be engaged with the support cylinder 18 and a hollow cylinder 22 or supported member to be engaged with the support pin 20. Accordingly, the unit U is changed from the first state to the second state and vice versa by turning the unit about the support cylinder 18 and support pin 20.

Figure 6:
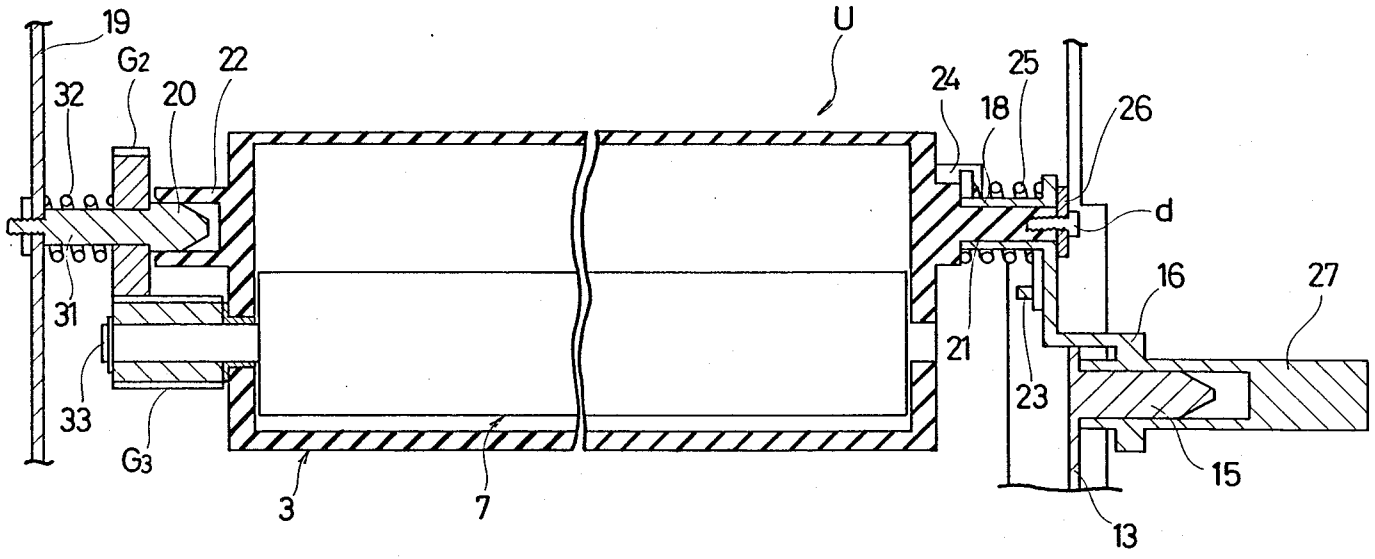
FIG. 6 is a longitudinal section of the first embodiment.
Figure 7:
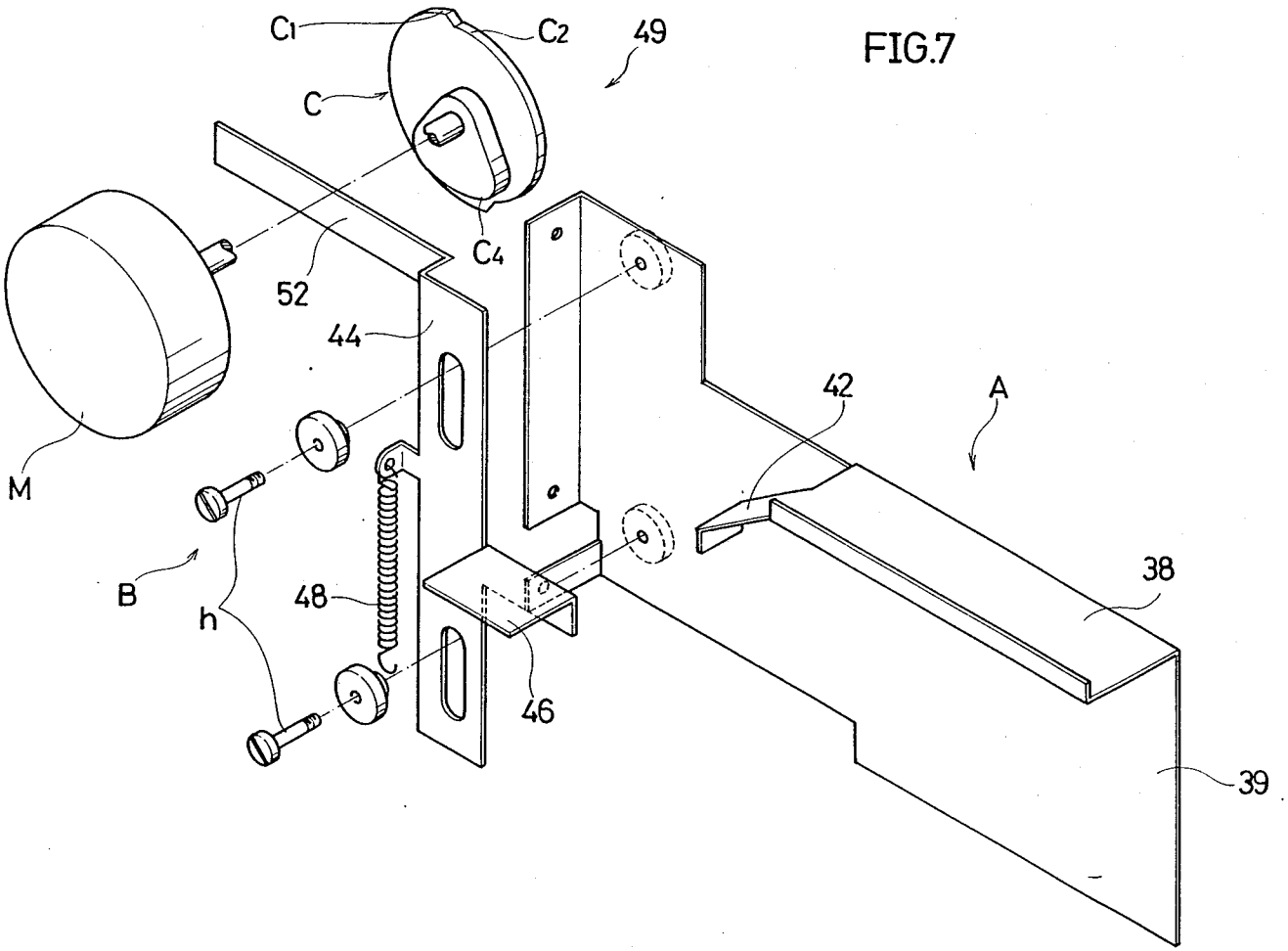
FIG. 7 is an exploded perspective view showing a unit changing mechanism.

Referring to FIGS. 4 and 6, the bracket 17 of the unit support member 16 has a curvilinear hole b near the hollow a of the support cylinder 18 and a spring receiver 23. Another spring receiver 24 is provided on an end face of the unit U opposite to the bracket 17. The unit support member 16 and the unit U are connected to each other as follows. The pin 21 is inserted into the hollow a of the the support cylinder 18 with a spring 25 for urging the unit U to the first state held by the receivers 23, 24. Also, a stem c formed on the forward end of the spring receiver 24 is placed through the curvilinear hole b. Further, a plate 26 is fixedly attached to the pin 21 and the receiver 24 by screws d, d. Accordingly, the unit U is able to turn about the supporting portion of the support cylinder 18 and pin 21 within an extent defined by the curvilinear hole b.

A developing unit which is not provided with such a spring 25 and constructed such as to move to the developing position by the weight thereof is liable to vibrate and lose the stability. The spring 25 is provided to prevent such an undesirable incident.

The unit receiving member 13 has an engaging recess e. The unit support member 16 has a handle 27 pivotably attached with a lever 28. The lever 28 has an engaging projection f engagable the engaging recess e. A spring 29 is provided between the lever 28 and a receiver 30 formed on the handle 27 so as to hold the engaging projection f in the engaging position. Accordingly, the unit support member 16 is removably attached to the unit receiving member 13. The engaging projection f has a tapering side g in the forward portion thereof. The tapering side makes it possible to automatically engage the engaging projection f with the engaging recess e when sliding the unit U inwards with the support pins 15 placed through cavities i formed in the unit support member 16.

Referring to FIGS. 3 and 6, a gear $G_2$ which is meshed with a driver gear $G_1$ is axially slidably attached to a stem portion 31 of the support pin 20 and biasedly held to the support pin 20 by a spring 32. On the other hand, ends of a sleeve shaft 33, agitating shaft 34, and intermediate shaft 35 are projected from the casing 3 toward the rear panel 19. To the shaft ends are fixedly attached gears $G_3$, $G_4$, and $G_5$ respectively, the gears being meshed with one another. The gears are arranged so that the gear $G_3$ comes into engagement with the gear $G_2$ when the unit U is inserted and the hollow cylinder 22 engages the support pin 20. It will be noted that even if a side of a tooth of the gear $G_3$ comes into contact with that of the gear $G_2$ an the gear $G_2$ is moved toward the rear panel 19 resisting the spring 32 when engaging the gear $G_3$ with the gear $G_2$, the gears $G_2$ and $G_3$ can be engaged with each other by rotating the gear $G_2$ a little.

In FIGS. 2 to 4, and 7 is also shown a guide mechanism A adopted when inserting and drawing the developing unit U in the axial direction of the sleeve. The guide mechanism A includes a member 36 provided in the lower portion of the inserting hole 14 of the unit receiving member 13 for supporting the bottom portion of the casing 3, a guide projection 37 formed on the underside of the rear end of the casing 3, a guide plate 38 connected to a vertical plate 39 for supporting the guide projection 37, a guide hook 40 formed on the top of the rear end of the casing 3, and a guide rail 41 attached to the receiving member 13 for guiding the hook 40.

The guide mechanism A is constructed in such a manner that immediately after the unit support member 16 is supported by the support pins 15, 15 and the hollow cylinder 22 provided on the rear end face of the casing 3 is supported by the support pin 20, the supporting member 36 for supporting the underside of the casing, guide plate 38 and guide rail 41 are refrained from supporting the casing 3. A guide plate 42 is connected to the guide plate 38, which is inclined downward and adopted for guiding and supporting the projection 37 formed on the underside of the casing 3.

As shown in FIGS. 1, 2, 7 to 9, a unit changing mechanism B is provided near the rear panel 19. The mechanism B is adopted for changing the sleeve 5 from the first state to the second state and vice versa when the unit U is set in the position and comprises a slide plate 44 vertically movable along upper and lower screw rods h, h attached to the vertical plate 39 of the guide mechanism A, the slide plate 44 being provided with a plate 46 for supporting the projection 37 formed on the underside of the casing, a spring 48 for urging the slide plate 44 downwards, and a lifting mechanism 49 for lifting the slide plate 44 resisting the spring 48.

Figure 8:
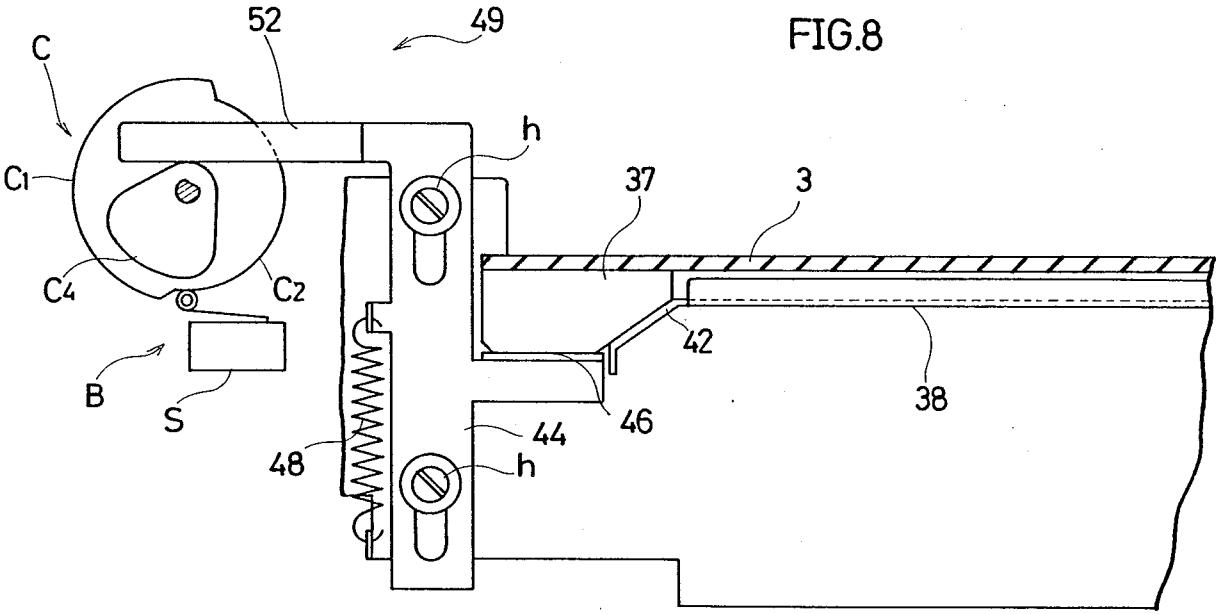
FIGS. 8 and 9 are explanatory views illustrating changed state.
Figure 9:
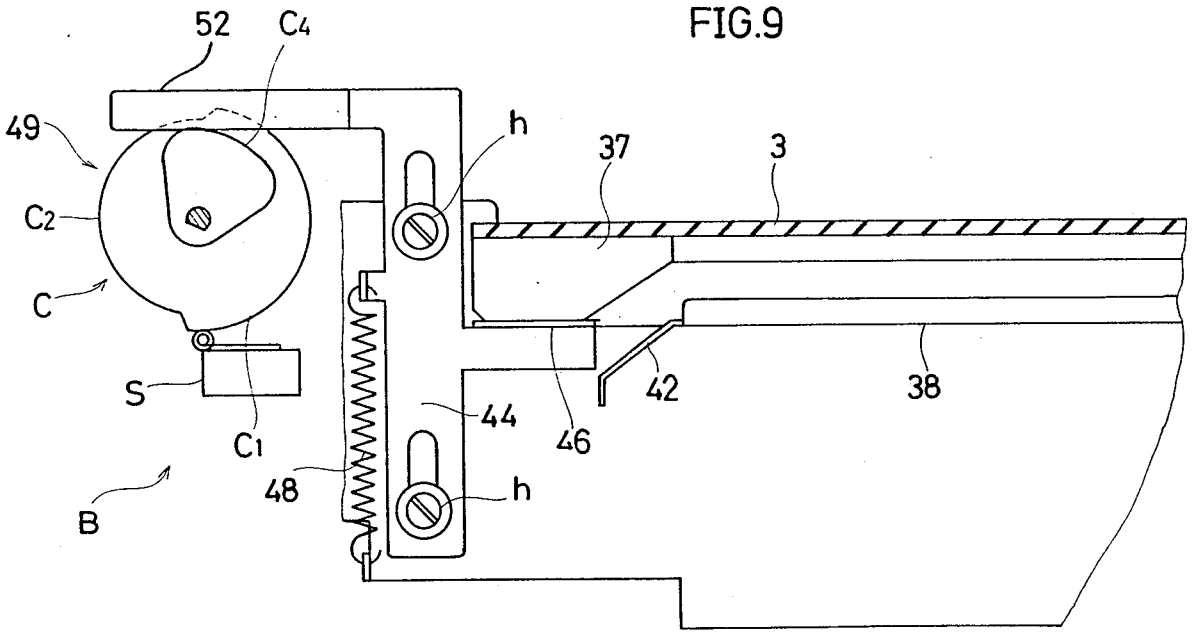

The lifting mechanism 49, a specific construction of which will be described later, serves to selectably raising the top face of the supporting plate 46 from a position in which the top face is held by the spring 48 at the same level as the lower end of the inclined plate 42 as shown in FIG. 8 to a position in which the top face is at substantially the same level as the top face of the guide plate 38 as shown in FIG. 9. At the position of FIG. 8, in which the supporting plate 46 is levelled down by the spring 48, the sleeve 5 of the unit U is held at the first state. On the other hand, at the position of FIG. 9, in which the plate is levelled up resisting the spring 48, the sleeve of the unit U is held at the second state.

Accordingly, it will be seen that the developing unit U can be desirably changed from the state that the unit U is associated with the developing operation to the state that the unit U is not associated with the developing operation. Also, a developing unit U can be replaced by another developing unit U loaded with a developer of a color different from a developer contained in the former unit U by releasing the lock of the engaging recess e and engaging projection f, drawing the former unit, and inserting the latter unit. It will be seen, therefore, that the monocolor developing is possible which uses different color developers changefully. Furhermore, there is no likelihood that a magnetic brush of developer mars the photoreceptor surface when drawing and inseting the developing unit U since the unit U is held in the second state that the sleeve 5 is kept apart form the photoreceptor 1. In other words, the developing unit is changed from the first state, or the developing state in which the magnetic brush is in contact with the photoreceptor surface, to the second state on account of a fact that when drawing the unit U, the projection 37 provided on the casing 3 climbs upto the guide plate 38 along the inclined plate 42. Accordingly, even if the developing unit U is drawn from the first state, the magnetic brush is not liable to mar the photoreceptor surface except for the initial moment of drawing.

The construction of the lifing mechanism 49 will be described. The mechanism 49 comprises a motor M to be actuated when turning on a switch (not shown) for puting the developing unit U into operation, a cam body C communicated with the motor M, the cam C including two semicircle cam portions $C_1$, $C_2$ having different radii, a fan-shaped cam $C_4$ attached to the cam body C, a switch S for detecting half rotation of the cam body C and then stopping the motor M, and a cam follower 52 formed on an upper portion of the slide plate 44 and disposed on the top of the fan-shaped cam $C_4$ for lifting the slide plate 44 resisting the spring 48.

Although the above-mentioned embodiment is shown to be equipped with the unit change mechanism B for changing the developing unit U from the first state that the sleeve is near the photoreceptor in the developing stage to the second state that the sleeve is apart from the photoreceptor in the non-developing stage and vice versa when setting the unit in the apparatus, a device of the present invention may be such a construction that the developing unit is put in only the first state when setting the unit in the apparatus without having the unit change mechanism B.

Another embodiment of the present invention will be described with reference to FIGS. 10 to 14. In the first embodiment is shown a device including one developing unit U. which is used for monocolor developing. On the other hand, in the second embodiment, which will be described below, the device is shown which includes two developing units U, U arranged around the photoreceptor. The developing units U, U have the same construction as that of the first embodiment. Accordingly, like parts corresponding to the first embodiment are designated by like reference characters to avoid repeating the same description.

Figure 10:
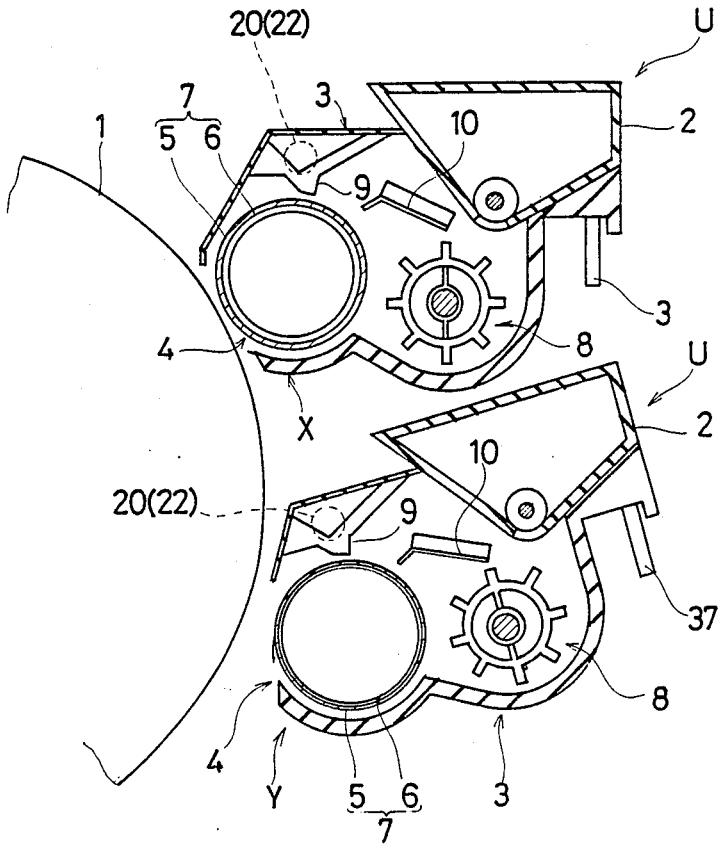
FIG. 10 is a skeleton section of a second embodiment of the present invention.

Referring now to FIG. 10, an upper unit U is held in the first state X that developing can be executed. An lower unit U is held in the second state Y that developing can not be executed. The two states are oppositely changed by a unit change mechanism B to be described later.

Figure 11:
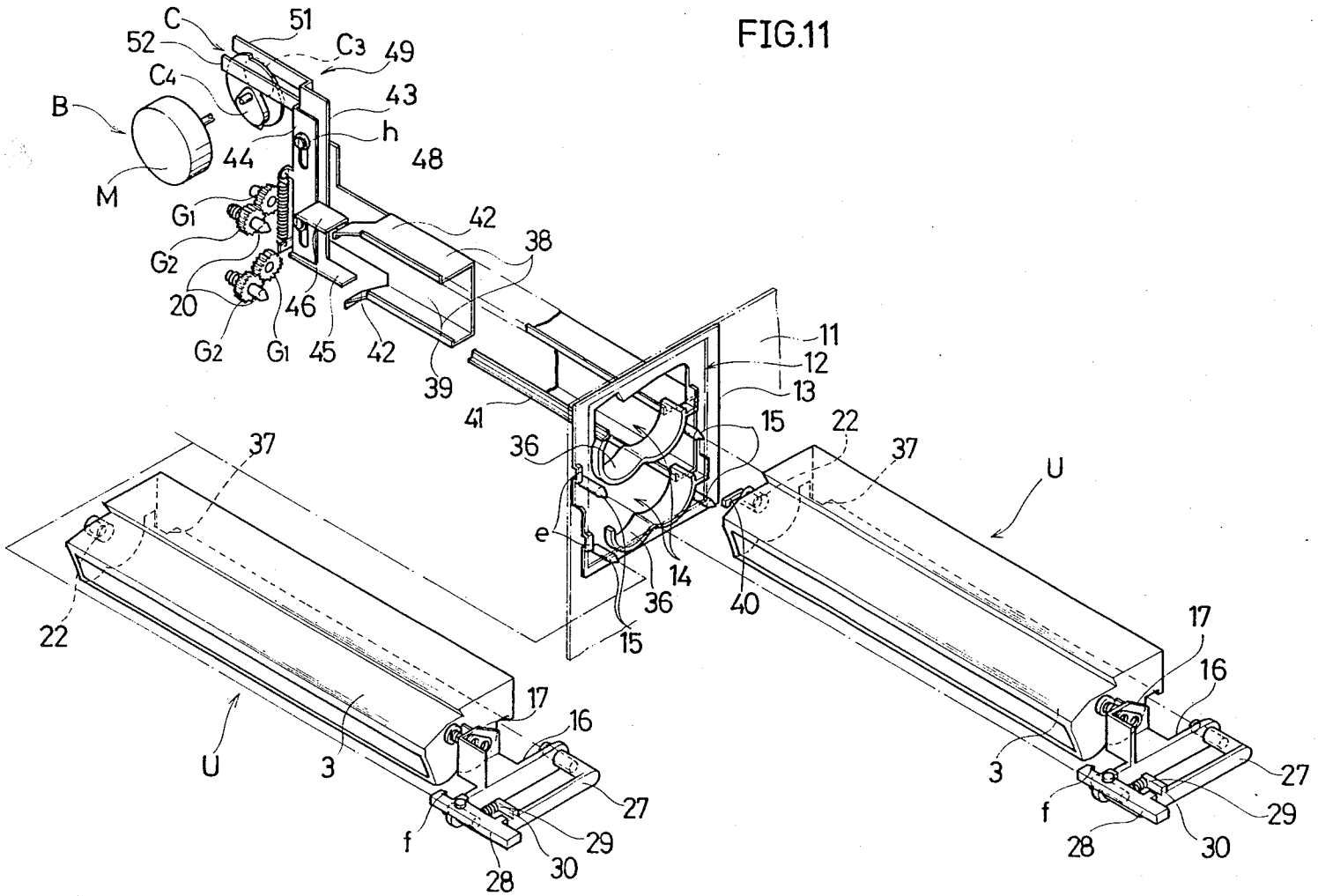
FIG. 11 is a perspective view illustrating inserting and drawing of developing units of the second embodiment.

As shown in FIG. 11, a unit receiving member 13 has vertically arranged two unit insertion holes 14, 14 and two support pins 15, 15 provided near each hole 14 to which a unit support member 16 is removably attached. Developing units U, U are the same in construction as the first embodiment.

Figure 12:
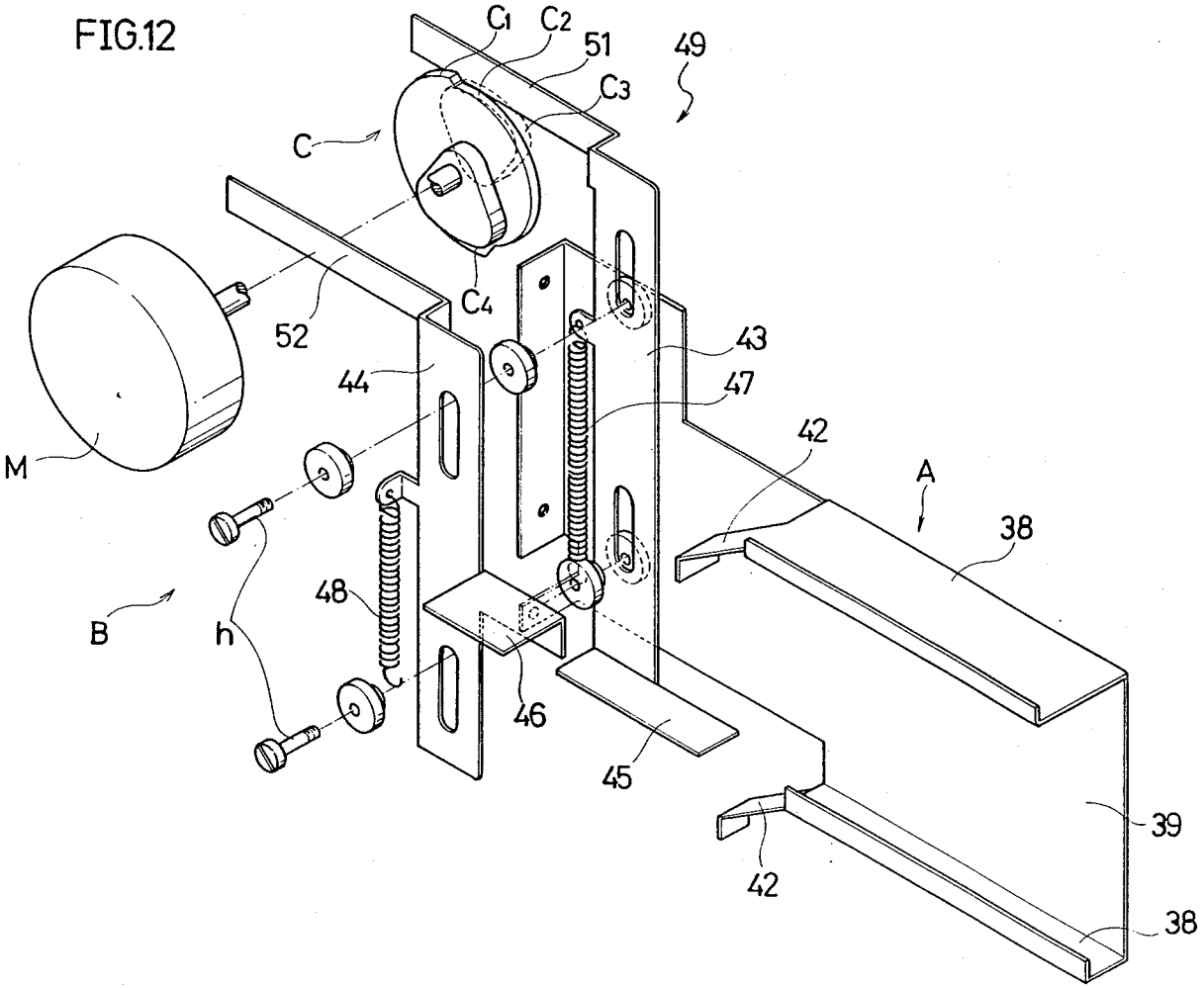
FIG. 12 is an exploded perspective view showing a unit changing mechanism of the second embodiment.

In FIGS. 11 and 12 is shown a guide mechanism A used when inserting and drawing the unit U along the axis of sleeve. The guide mechansim A comprises two supporting members 36, 36 provided on the lower edges of the unit insertion holes 14, 14 of the unit receiving plate 13 for supporting the underside of the casing 3, guide plates 38, 38 connected to a vertical plate 39 for supporting a guide projection 37 formed on the underside of the forward portion of each casing 3.

The casing 3 of the upper developing unit U has a hook-like guide body 40 in the top of the forward portion thereof. A guide rail 41 for the hook-like guide body 40 is connected to the unit receiving plate 13.

The guide mechanism A is constructed in such a manner that immediately after support member 16 is supported by the support pins 15, 15 and a hollow cylinder 22 provided on the rear end face of the casing 3 is supported by a support pin 20, the supporting member 36 for supporting the underside of the casing, guide plates 38, 38 and guide rail 41 are refrained from supporting the casing 3. Moreover, to support the projection 37 formed on the underside of the casing 3 when the guide plates 38, 41 are refrained from supporting the casing, guide plates 42, 42 are connected to the guide plates 38, 38 respectively. The guide plates 42 is inclined downwards.

As shown in FIGS. 10 to 14, the unit change mechanism B is provided near the rear panel 19, which is adopted for changing the sleeve 5 of one developing unit U to the first state X and changing the sleeve 5 of another developing unit U to the second state Y at the same time. The unit change mechanism B comprises two slide plates 43, 44 vertically movable on upper and lower screws H attached to the vertical plate 39 of the guide mechanism A, supporting plates 45, 46 provided on the slide plates 43, 44 respectively for supporting the projections 37, 37, springs 47, 48 for urging the slide plates 43,44 downwards, and a lifting mechanism 49 for lifting the slide plates 43, 44 resisting the springs 47, 48.

Figure 13:
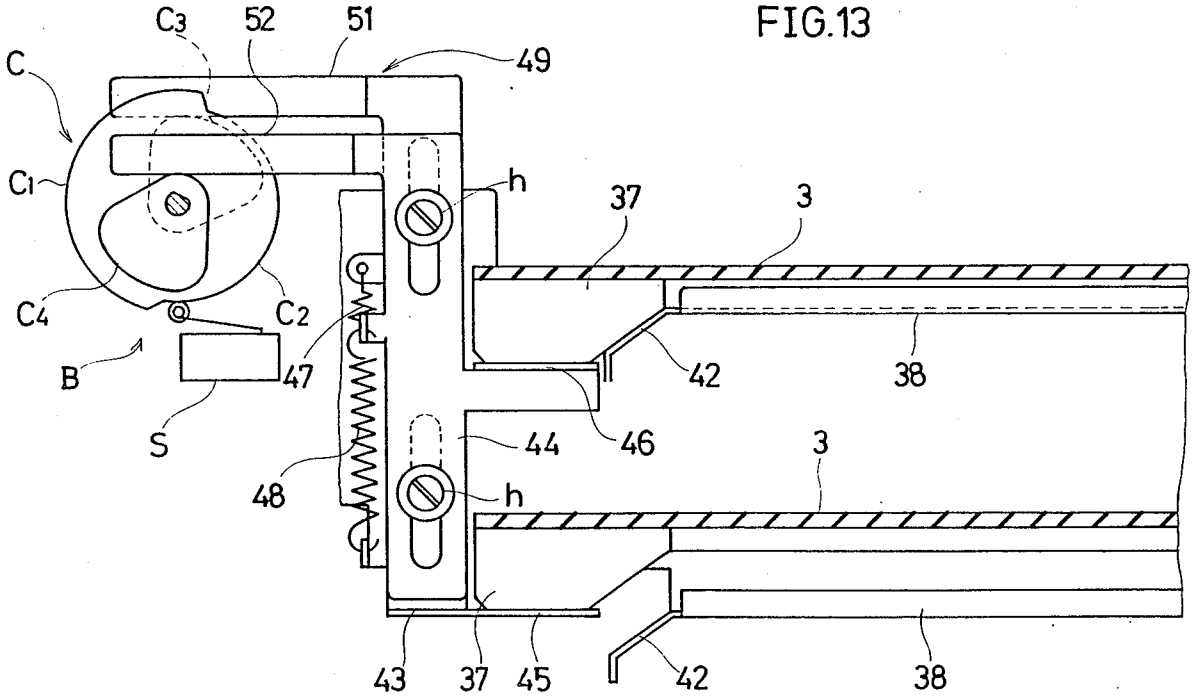
FIGS. 13 and 14 are explanatory views illustrating changed states.
Figure 14:
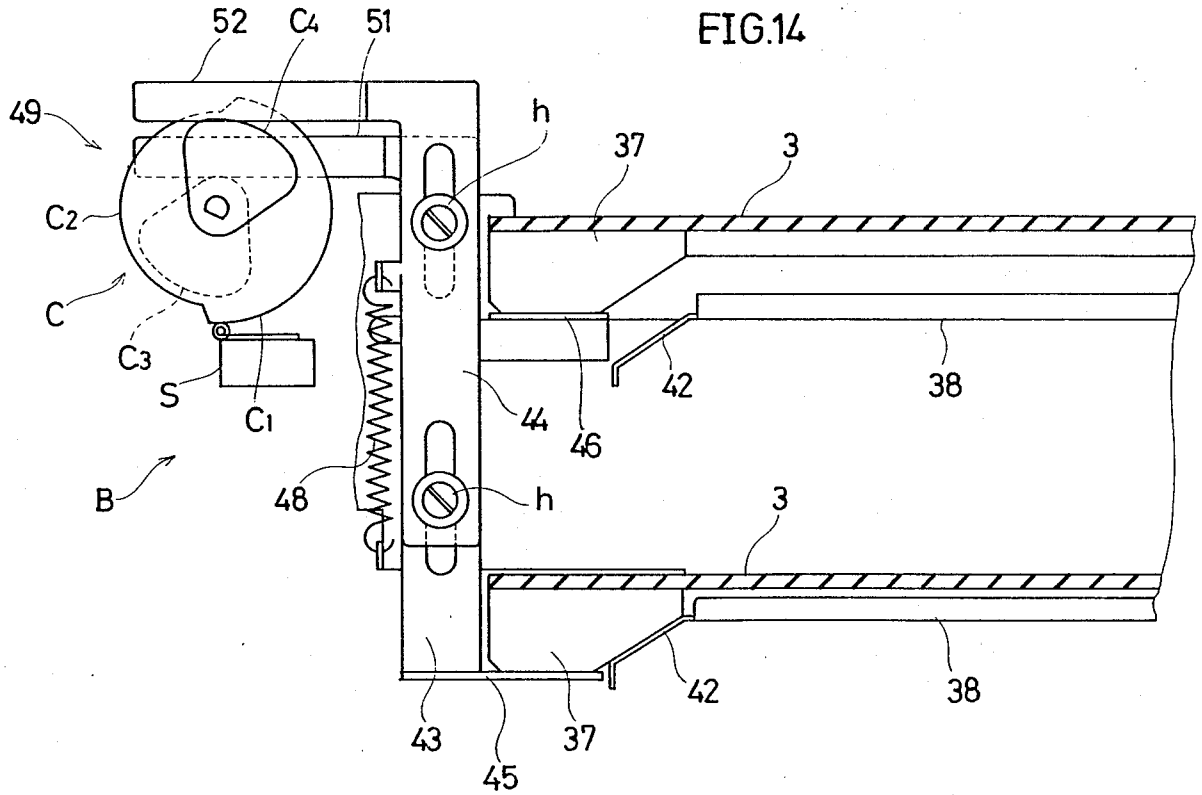

The lifting mechanism 49, a specific construction of which will be described later, serves to selectably raise the top faces of the supporting plates 45, 46 from a position in which the top face is held by the springs 47, 48 at the same level as the lower end of the inclined plates 42, 42, as shown FIGS. 12 to 14, to a position in which the top faces of the supporting plates 45, 46 are at substantially the same level as the top faces of the guide plates 38, 38. As shown in FIG. 13, when the supporting plate 46 is levelled down by the spring 48 and the supporting plate 45 is levelled up resisting the spring 47, the sleeve 5 of the upper unit U is held in the first state X and the sleeve 5 of the lower unit U is held in the second state Y. Conversely, as shown in FIG. 14, when the supporting plate 46 is levelled up resisting the spring 48 and the supporting plate 45 is levelled down by the spring 47, the sleeve 5 of the upper unit U is held in the second state Y and the sleeve 5 of the lower unit U is held in the first state X.

Accordingly, it is made possible that when one developing unit is put into developing operation, the other developing unit is perfectly refrained from developing operation, which assures monocolor developing of a particular color seleced from two color. A developing unit can be desirably replaced by another unit holding a developer of a color different from the former unit by releasing the lock of the engaging recess e and engaging projection f, drawing the former unit and inserting the latter unit in the appartus. Therefore, it is possible to use developers of differnt colors separately to develop a multicolored image. Furthermore, there is no likelihood that a magnetic brush of developer mars the photoreceptor surface when drawing and inserting the developing unit U since a unit U refrained from developing operation is held in the second state Y in which the sleeve 5 is kept apart from the photoreceptor 1. Also, with the devloping unit put into developing operation and therefore held in the first state X in which a magnetic brush is in contact with the photoreceptor surface, on account of a fact that when drawing the unit U, the projection 37 provided on the casing 3 climbs upto the guide plate 38 along the inclined plate 42, so that the unit U comes into the second state Y, even if the developing unit U is drawn from the first state X, the magnetic brush is not liable to mar the photoreceptor surface except for the initial moment of drawing.

The construction of the lifting mechanism 49 will be described. The mechanism 49 comprises a motor M to be actuated when turning on a selection switch (not shown) for putting the developing unit U into operation, a cam body C communicated with the motor M, the cam C including two semicircle cam portions $C_1$, $C_2$ having different radii, two fan-shaped cams $C_3$, $C_4$ having the same radius attached to the cam body C with the cams $C_3$, $C_4$ 180° out of phase, a switch S for detecting half rotation of the cam body C and then stopping the motor M, and cam followers 51, 52 formed on upper portions of the slide plates 43, 44 and disposed on the top of the fan-shaped cams $C_3$, $C_4$ for lifting the slide plates 43, 44 resisting the spring 47, 48.

Furthermore, provided that device is constructed such that in the warming up stage and cleaning stage, the supporitng plates 45, 46 are made to stop at the middle level, it is assured that both developing units are suspended from developing operation and the photoreceptor 1 is prevented from rotating while magnetic brush is in contact with the photoreceptor surface.

Although this embodiment is described in connection with the device loaded with two developing units, the present invention may be applied for a device including three or more developing units of which one or more units is selectably put into developing operation.

What we claim is:

1. A developing device comprising an image forming apparatus having a photoreceptor with a longitudinal axis, a developing unit removably mounted in said image forming apparatus, said developing unit having a front end and a rear end, said developing unit having a developing sleeve with a longitudinal axis which is parallel to the longitudinal axis of said photoreceptor, said image forming apparatus having a front panel means and a rear panel means, said front panel means having opening means defining an opening through which said developing unit is inserted into and withdrawn from said image forming apparatus, front unit support means mounted on said front panel means and extending to said opening for pivotally supporting said front end of said developing unit, rear unit support means on said rear panel means for pivotably supporting said rear end of said developing unit such that said developing unit is thereby pivotable between a first stage and a second stage in which said developing sleeve is closer to said photoreceptor when in said first stage than when in said second stage, guide means on said image forming apparatus for guiding said developing unit as said developing unit is inserted and withdrawn from said image forming apparatus, said guide means having a first section which disposes said developing unit at said second stage during said insertion and withdrawal, said guide means having a second section operable to dispose said developing unit at said first stage when said developing unit is fully inserted in said image forming apparatus, said guide means having an inclined means between said first and second sections which engages said developing unit to move said developing unit from said first stage to said second stage when said developing unit is withdrawn from said image forming apparatus, whereby the developing unit is thereby automatically disposed at said second stage as said developing unit is withdrawn from said image forming apparatus.

2. A developing device according to claim 1 further comprising spring biasing means connected between said unit and said apparatus for biasing said unit to said first stage.

3. A developing device according to claim 1 further comprising changing means operably connected to said second section of said guide means for moving said second section between first and second positions, said second section when in said first position engaging said unit to dispose said unit at said first stage, said second section when in said second position engaging said unit to dispose said unit at said second stage.

4. A developing device according to claim 3 wherein said changing means comprises cam means rotatably mounted on said apparatus, and a slide member slidably mounted on said apparatus, said slide member being connected to said second section of said guide means, said cam means operably engaging said slide member to thereby cause said slide member to move said second section of said guide means between said first and second positions.

5. A developing device according to claim 4 further comprising spring biasing means connected between said slide member and said apparatus for biasing said slide member in a position to dispose said second section of said guide means at said first postion.

6. A developing device according to claim 1 wherein said unit comprises a casing having a casing surface and a guide projection projecting from said casing surface, said guide projection slidably and sequentially engaging said first section and said inclined means as said unit is initially inserted intoQ said apparatus, said guide projection overlying said second section of said guide means when said unit is fully inserted in said apparatus.

7. A developing device according to claim 6 further comprising a support means on said front panel means underlying and supporting said casing means as said guide projection slidably engages said first section during said initial insertion of said unit, said support means being displaced from a position underlying said casing means when said unit is in said fully inserted position.

8. A developing device according to claim 1 wherein said front unit support means comprises mounting means detachably mounting said front unit support means on said front panel means, said front unit support means having pivotal means exending to a position juxtaposed to said opening in said front panel means for pivotably supporting said unit.

9. A developing device according to claim 8 wherein said mounting means mounts said front unit support means on said front panel means to preclude relative movement between said front unit support means and said front panel means.

10. A developing device according to claim 9 wherein said mounting means comprises a spring biased latch for latching said front unit support means to said front panel means.

11. A developing device comprising an image forming apparatus having a photoreceptor with a longitudinal axis, a developing unit removably mounted in said image forming apparatus, said developing unit having a front end and a rear end, said developing unit having a developing sleeve with a longitudinal axis which is parallel to the longitudinal axis of said photoreceptor, said image forming apparatus having a front panel means and a rear panel means, said front panel means having opening means defining an opening through which said developing unit is inserted into and withdrawn from said image forming apparatus, front unit support means removably mounted on said front panel means and extending to said opening for pivotally supporting said front end of said developing unit, rear unit support means on said rear panel means for pivotably supporting said rear end of said developing unit such that said developing unit is thereby pivotable between a first stage and a second stage in which said developing sleeve is closer to said photoreceptor when in said first stage than when in said second stage, guide means on said image forming apparatus for guiding said developing unit as said developing unit is inserted and withdrawn from said image forming apparatus, said guide means having a first section which disposes said developing unit at said second stage during said insertion and withdrawal, said guide means having a second section operable to dispose said developing unit at said first stage when said developing unit is fully inserted in said image forming apparatus, operable means operably connected to said second section of said guide means for selectively moving said second section to a first position to dispose said developing unit at said first stage and to a second position to dispose said developing unit at said second stage, said guide means having an inclined means between said first and second sections which engages said developing unit to move said developing unit from said first stage to said second stage when said developing unit is withdrawn from said image forming apparatus, whereby the developing unit is thereby automatically disposed at said second stage as said developing unit is withdrawn from said image forming apparatus even though said operable means disposes said second section of said guide means in said first position.

12. A developing device comprising an image forming apparatus having a photoreceptor with a longtiudinal axis, two developing units removably mounted in said image forming apparatus, each of said developing units each having a front end and a rear end, each of said developing units having a developing sleeve with a longitudinal axis which is parallel to the longitudinal axis of said photoreceptor, said image forming apparatus having a front panel means and a rear panel means, said front panel means having opening means defining an opening through which said two developing units are inserted into and withdrawn from said image forming apparatus, front unit support means removable mounted on said front panel means and extending to said opening for pivotably supporting said front end of each of said developing units, rear unit support means on said rear panel for pivotably supporting said rear end of said of said developing units such that each of said developing units is pivotable between a first stage and a second stage in which the respective developing sleeve is closer to said photoreceptor when in said first stage than when in said second stage, two guide means on said image forming apparatus for guding each of said developing units as each of said developing units is inserted and withdrawn from said image forming apparatus, each of said guide means having a first section which disposes the respective developing unit at said second stage during said insertion and withdrawal of the respective developing unit, each of said guide means having a second section operable to dispose the respective developing units at said first stage when the respective developing unit is fully inserted in said image forming apparatus, each of said guide means having an inclined means between the respective first and second sections which engages the respective developing unit to move the respective developing unit from said first stage to said second stage when the respective developing unit is withdrawn from said image forming apparatus, whereby each developing unit is thereby automatically disposed at said second stage as the respective developing unit is withdrawn from said image forming apparatus.

13. A developing device comprising an image forming apparatus having a photoreceptor with a longitudinal axis, a developing unit removably mounted in said image forming apparatus, said developing unit having a front end and a rear end, said developing unit having a developing sleeve with a longitudinal axis which is parallel to the longitudinal axis of said photoreceptor, said image forming apparatus having a front panel means and a rear panel means, said front panel means having opening means defining an opening through which said developing unit is inserted into said withdrawn from said image forming apparatus, unit support means mounted on said front and rear panel means for supporting said developing unit for pivotal movement between a first stage and a second stage in which said developing sleeve is closer to said photoreceptor when in said first stage than when in said second stage, guide means on said image forming apparatus for guiding said developing unit as said developing unit is inserted and withdrawn from said image forming apparatus, said guide means having a first section which disposes said developing unit at said second stage during said insertion and withdrawal, said guide means having a second section operable to dispose said developing unit at said first stage when said developing unit is fully inserted in said image forming apparatus, said guide means having a third section between said first and second sections which engages said developing unit to move said developing unit from said first stage to said second stage when said developing unit is withdrawn from said image forming apparatus, whereby the developing unit is thereby automatically disposed at said second stage as said developing unit is withdrawn from said image forming apparatus.

* * * * *

UNITED STATES PATENT OFFICE

CERTIFICATE OF CORRECTION

Patent No. 4,740,767 Dated April 26, 1988

Inventor(s) Yuzo KAWANO and Yosuka OHATA

It is certified that error appears in the above-identified patent and that said Letters Patent are hereby corrected as shown below:

Column 11, line 48, change "removable" to -- removably --.

Column 11, line 53, change "said of said developing" to to -- each of said developing --.

Column 12, line 32, change "inserted into said withdrawn" to -- inserted into and withdrawn --.

Signed and Sealed this

Eighteenth Day of October, 1988

*Attest:*

DONALD J. QUIGG

*Attesting Officer*

*Commissioner of Patents and Trademarks*